US007206182B2

(12) United States Patent
Hsieh

(10) Patent No.: US 7,206,182 B2
(45) Date of Patent: Apr. 17, 2007

(54) NEGATIVE IONS GENERATING CIRCUIT DESIGN WITH DECREASING HIGH FREQUENCY NOISE AND APPARATUS THEREOF

(76) Inventor: Hsin-mao Hsieh, No. 6, East Section Industrial 6th Rd., Pingtung City, Pingtung (TW)

( * ) Notice: Subject to any disclaimer, the term of this patent is extended or adjusted under 35 U.S.C. 154(b) by 491 days.

(21) Appl. No.: 10/706,995

(22) Filed: Nov. 14, 2003

(65) Prior Publication Data

US 2005/0105241 A1 May 19, 2005

(51) Int. Cl.
*H01T 23/00* (2006.01)

(52) U.S. Cl. ..... 361/230; 361/231; 363/39; 363/42; 363/47

(58) Field of Classification Search ..... 361/231, 361/230; 363/39, 42, 47
See application file for complete search history.

(56) References Cited

U.S. PATENT DOCUMENTS 2,972,116 A * 2/1961 Lowe ..... 331/117 R
5,065,272 A * 11/1991 Owen et al. ..... 361/231
5,263,197 A * 11/1993 Manjo et al. ..... 455/324
6,042,637 A * 3/2000 Weinberg ..... 96/58
6,515,879 B2 * 2/2003 Terashita et al. ..... 363/39
6,919,053 B2 * 7/2005 Joannou ..... 422/186

* cited by examiner

*Primary Examiner*—Stephen W. Jackson
*Assistant Examiner*—Terrence Willoughby
(74) *Attorney, Agent, or Firm*—Troxell Law Office PLLC

(57) ABSTRACT

A negative ions generating circuit design with decreasing high frequency noise includes a power indication circuit, an oscillation circuit, an amplifying circuit and a radial frequency filtering circuit. The power indicating circuit, the oscillation circuit and the amplifying circuit are used for generating negative ions. The radial frequency filtering circuit has a capacitance to be utilized for limiting the high frequency in a coil so that the high frequency will not be amplified by through the transistor of the oscillation circuit. The coil creates an inductance to limit the high frequency so as to effectively eliminate the high frequency created by the oscillation circuit.

8 Claims, 3 Drawing Sheets

NEGATIVE IONS GENERATING CIRCUIT DESIGN WITH DECREASING HIGH FREQUENCY NOISE AND APPARATUS THEREOF

FIELD OF THE INVENTION

The present invention is relating to a circuit for generating negative ions, more particularly to a negative ions generating circuit design with decreasing high frequency noise.

BACKGROUND OF THE INVENTION

A well-known negative ions generating circuit was disclosed in U.S. Pat. No. 4,872,083 entitled "method and circuit for balance control of positive and negative ions from electrical A.C. air ionizers", which has a capacitor and a by-pass resistor. The capacitor is interposed between discharge electrode and A.C. high voltage source for generating a D.C. bias voltage between the discharge electrode and ground. The by-pass resistor is connected to the capacitor in parallel for providing a path to ground to bleed off excess bias. The by-pass resistor is an adjustable resistor whose resistance value is determined by a compensative value that is provided by the A.C. air ionizer to measure air environmental contamination, thereby to provide an equilibrium bias to generate the correct ratios of positive and negative ion currents and balance the densities of positive and negative ion. However, high frequency accompanying high voltage produced by the transformer is not mentioned how to be eliminated in the U.S. Pat. No. 4,872,083.

SUMMARY

The primary object of this invention is to provide a circuit for generating negative ions, which uses a capacitance of a radial frequency eliminating circuit to by-pass high frequency to ground. A coil of the radial frequency eliminating circuit is connected with a transistor of an oscillation circuit in series and an inductance produced by the coil of the radial frequency eliminating circuit limits the high frequency, so that the high frequency will not pass through the transistor of the oscillation circuit to be amplified in order to effectively eliminate the high frequency that is created by the oscillation circuit thereby eliminating any potential negative effects on the human body.

The secondary object of this invention is to provide a circuit for generating negative ions. A π-shaped radial frequency filtering circuit including a coil, a first capacitance and a second capacitance is utilized for making the high frequency to be by-passed to ground and to be blocked by the coil, so that the high frequency noise will not escape.

The third object of this invention is to provide a negative ion generator. A shelter is used for wrapping transformer, transistor and coil of radial frequency eliminating circuit in the negative ions generating circuit for producing a shielding effectiveness to avoid the high frequency radiation from the negative ions generating apparatus.

The negative ions generating circuit design with decreasing high frequency noise according to the present invention includes a power indication circuit, an oscillation circuit, an amplifying circuit and a radial frequency eliminating circuit. The power indication circuit is utilized for displaying power on/off and the oscillation circuit has a transformer and an oscillation loop. The current from the power indication circuit flows to the oscillation circuit. The transformer configures to generate high voltage that produces a resonant frequency by through the oscillation loop. The oscillation loop has a transistor that includes a base, a collector and an emitter, the base and the collector of the transistor are electrically connected with the transformer. The amplifying circuit, is connected with at least a discharge electrode, configures to rectify the current flowing to the oscillation circuit and discharge negative ions through the discharge electrode. The radial frequency eliminating circuit comprises a capacitance (C4) and a coil (L2), and the capacitance (C4) is connected with the coil (L2) in parallel. The capacitance (C4) is electrically connected with the base of the transistor and the coil (L2) is electrically connected with the emitter of the transistor in series. The capacitance (C4) by-passes the high frequency to ground, and the coil (L2) produces an inductance to limits the high frequency for avoiding the high frequency from passing through the transistor of the oscillation circuit to be amplified in order to effectively eliminate the high frequency that is created by the oscillation circuit to endanger human body.

DETAILED DESCRIPTION OF THE PRESENT INVENTION

Figure 1:
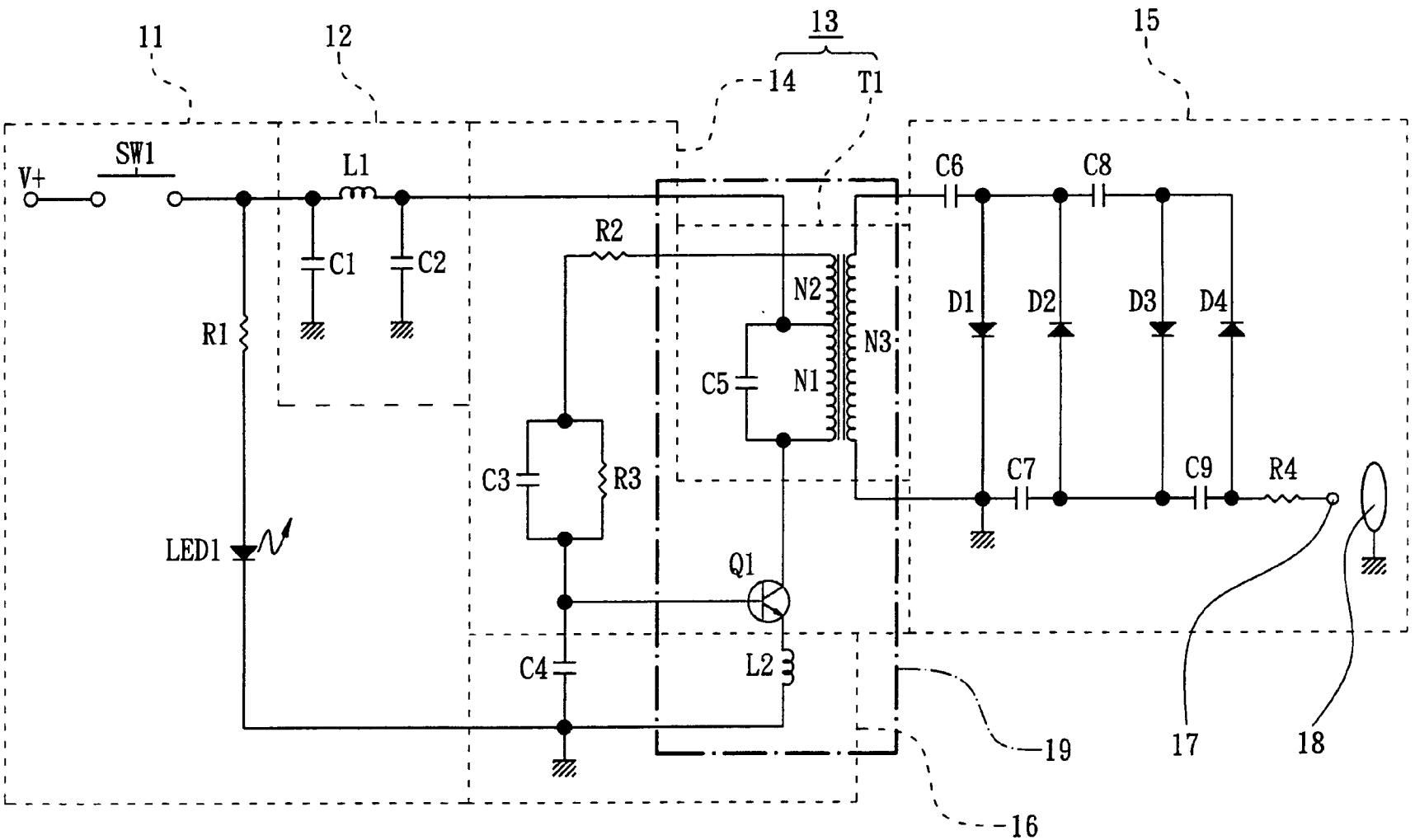
FIG. 1 is a diagram of circuit in accordance with the present invention.

Referring to the drawings attached, the present invention will be described by means of the embodiments below.

Figure 2:
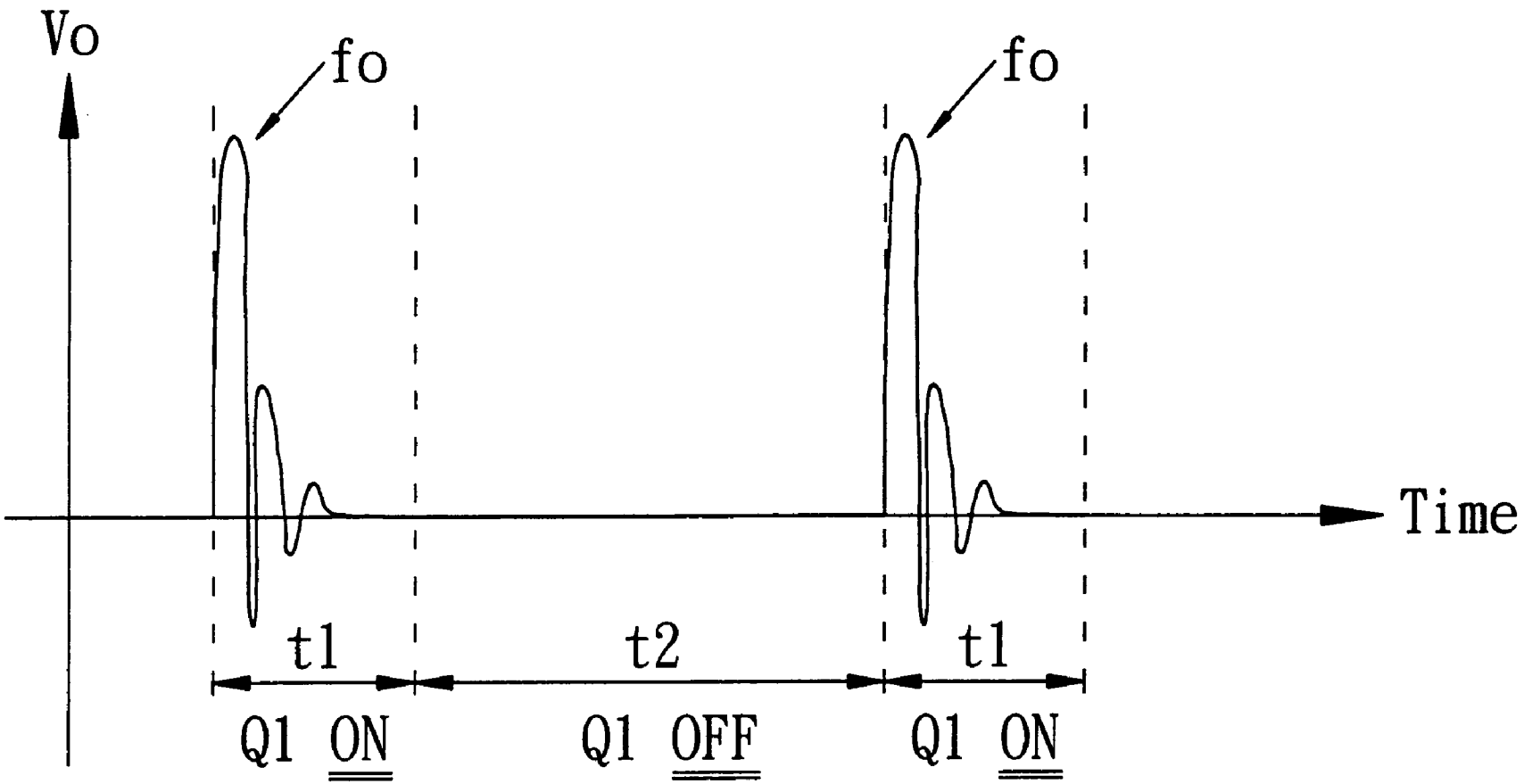
FIG. 2 is a wave diagram of the oscillation circuit in accordance with the present invention.

According to an embodiment of the present invention as showed in FIG. 1, a circuit for generating negative ions for decreasing high frequency noise includes a power indication circuit 11, an oscillation circuit 13, an amplifying circuit 15 and a radial frequency eliminating circuit 16. Preferably, the negative ions generating circuit design further includes a radial frequency filtering circuit 12. The power indication circuit 11 configures to display power on/off. The power indication circuit 11 has a switch SW1, a first resistor R1 and a light emitting diode LED1. When the switch SW1 is in "on" state, a current passes through the first resistor R1 and is lighting the light emitting diode LED1. Also the current flows to the radial frequency filtering circuit 12. The radial frequency filtering circuit 12 is a π-shaped circuit and has a first coil L1, a first capacitance C1 and a second capacitance C2. The first capacitance C1 and the second capacitance C2 are grounded. The first capacitance C1 an the second capacitance C2 have low impendence to high frequency, so that high frequency will be blocked by the first coil L1 to decrease the leakage and interruption of high frequency noise. The current further flows to the oscillation circuit 13 to produce a high voltage, the oscillation circuit 13 has a transformer T1 and an oscillation loop 14, and the transformer T1 which possesses a primary coil N1, a positive feedback coil N2, a secondary coil N3 and a fifth capacitance C5. The high voltage passes through the oscillation loop 14 to configured to high frequency generate a resonant frequency. The oscillation loop 14 possesses a transistor Q1, a second resistor R2, a third resistor R3 and a third capacitance C3. The transistor Q1 has a base, a collector and an emitter, and the base and collector of the transistor Q1 are electrically connected to the transformer T1. FIG. 2 is a wave diagram illustrating periodic variation of the oscillation circuit. During the conductive time t1, the current flows to the positive feedback coil N2, the second resistor and the third capacitance C3 to turn the transistor Q1 from "OFF" state to "ON" state, wherein the conductive time t1 is decided by the second resistor R2 and the third capacitance C3. The current passes through the second resistor R2 and charges the third capacitance C3. Accompanying the third capacitance C3 is charged gradually, the current flowing to the base of the transistor Q1 will become fewer gradually resulting in fewer and fewer current flowing to the collector of the transistor Q1. During the cut-off time t2, when the third capacitance C3 is charged to fill gradually the current flowing to the transistor will become fewer, at the time the positive feedback coil N2 will induce an anti-electromotive force and discharge a negative voltage to turn the transistor Q1 from "ON" state to "OFF" state, wherein the cut-off time t2 is decided by the third resistor R3 and the third capacitance C3, then the potential difference between the third capacitance C3 and the third resistor R3 decreases to zero. When the ratio of secondary coil N3 and primary coil N1 of the transformer T1 (N3/N1) is greater than 1, the oscillation circuit 13 will increase the voltage. While voltage is increased again, the current will flow through the positive feedback coil N2, the second resistor R2 and the third capacitance C3 to conduct the transistor Q1 so as to form a periodic oscillation.

In this embodiment, the amplifying circuit 15 has a sixth capacitance C6, a seventh capacitance C7, an eighth capacitance C8 and a ninth capacitance C9. A first diode D1, a second diode D2, a third diode D3 and a fourth diode D4 are connected to the halfway between the sixth capacitance C6 and the ninth capacitance C9 in parallel. The amplifying circuit 15 is also connected with a fourth resister R4 and at least a discharge electrode 17 in parallel. The discharge electrode 17 corresponds to a discharge panel 18. The amplifying circuit 15 configures to rectify the current flowing to the secondary coil N3 with an ascending voltage and discharging negative ions by the discharge electrode 17 and the discharge panel 18. The oscillation circuit 13 produces not only base wave frequency but also many unwanted high frequencies. The high frequency will cause a bad effect by radiation leakage while the oscillation circuit 13 is working. The radial frequency filtering circuit 16 that is connected to one side of the oscillation circuit 13, which has a fourth capacitance C4 and a second coil L2. The fourth capacitance C4 is connected with the second coil L2 in parallel and electrically connected with the base of the transistor Q1, the second coil L2 is connected with the emitter of the transistor Q1 in series. The fourth capacitance C4 by-passes high frequency to ground and the inductance produced by the second coil L2 can limits the high frequency, so that the high frequency will not be amplified by the transistor Q1 of the oscillation circuit 13 in order to effectively eliminate the high frequency that is generated by the oscillation circuit 13 to endanger human body.

Figure 3:
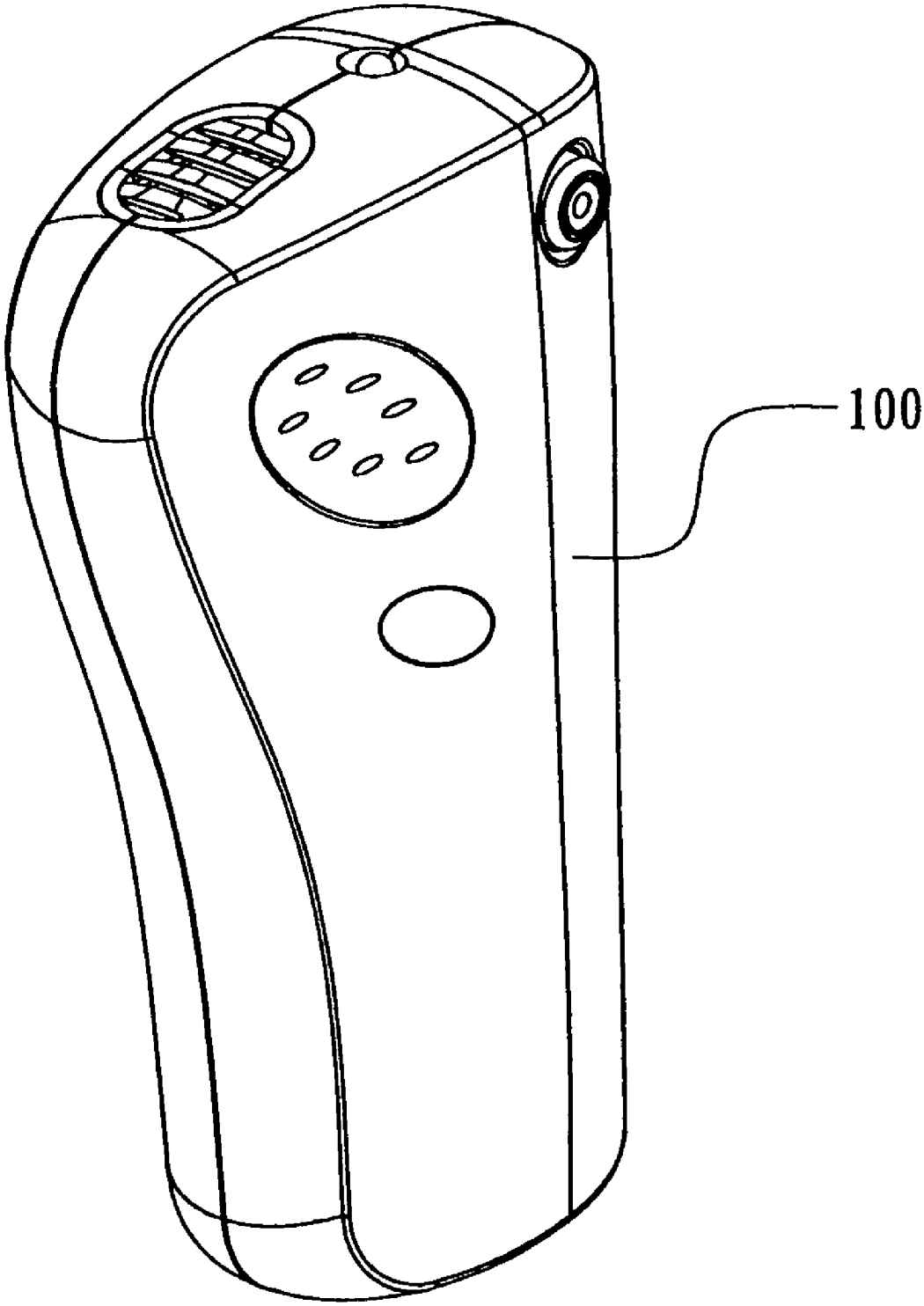
FIG. 3 is a diagram of portable negative ions generator.

A negative ion generator manufactured by utilizing the negative ions generating circuit design with decreasing high frequency noise function of the present invention includes not only the foregoing circuit design to eliminate the high frequency that could harm human body but also a shelter 19 made of metal, such as iron, aluminum or copper, for wrapping the transformer T1 and the transistor Q1 of the oscillation circuit 13, and the second coil L2 of the radial frequency filtering circuit 16 to produce a shielding effectiveness so as to eliminate high frequency radiation of the negative ions generating apparatus. Besides, the foregoing negative ions generating circuit design with decreasing high frequency noise and the apparatus thereof is also able to be installed to a housing of a portable negative ions generator 100 as showed in FIG. 3 or other electronic devices in order to generate negative ions and eliminate high frequency noise.

The above description of embodiments of this invention is intended to be illustrated are not limiting. Other embodiments of this invention will be obvious to those skilled in the art in view of the above disclosure.

What is claimed is:

1. A circuit for generating negative ions comprising:
a power indication circuit for displaying power on/off;
an oscillation circuit including a transformer and an oscillation loop, the transformer being configured to generate a high voltage to produce a resonant frequency through the oscillation loop, the oscillation loop having a oscillation loop capacitor (C3) and a transistor, the transistor having a base, a collector and an emitter, the base and the collector of the transistor being electrically connected to the transformer;
an amplifying circuit connected with at least a discharge electrode, the amplifying circuit configured to rectify current flowing to the oscillation circuit and discharge negative ions through the discharge electrode; and
a high frequency eliminating circuit having a eliminating capacitor (C4) and a coil (L2), the eliminating capacitor (C4) being connected in series with the coil (L2), and the coil (L2) being connected to the emitter of the transistor in series, wherein the eliminating capacitor (C4) and the oscillation loop capacitor (C3), and the capacitance (C3) of the oscillation loop are both electrically connected to the base of the transistor.

2. The circuit in accordance with claim 1, further comprising a high frequency filtering circuit connecting the power indication circuit with the transformer of the oscillation circuit, the frequency filtering circuit having a first capacitance (C1), a second capacitance (C2) and a coil (L1).

3. A circuit for generating negative ions comprising:
a power indication circuit for displaying power on/off;
an oscillation circuit having a transformer and an oscillation loop, an output current from the power indication circuit flowing to the oscillation circuit, the transformer configured to generate a high voltage to produce a resonant frequency through the oscillation loop, the oscillation loop having a transistor, the transistor having a base, a collector and an emitter, the base and the collector of the transistor being electrically connected to the transformer;
an amplifying circuit connected with at least a discharge electrode, the amplifying circuit configured to rectify current flowing to the oscillation circuit and discharge negative ions through the discharge electrode; and
a high frequency filtering circuit having a first capacitance, a second capacitance and a first coil, the high frequency filtering circuit connecting the power indication circuit with the transformer of the oscillation circuit.

4. The circuit in accordance with claim 3, wherein the oscillation circuit has a third capacitance electrically connected to the base of the transistor and the transformer.

5. A negative ion generator comprising:
a circuit for generating negative ions comprising:
a power indication circuit for displaying power on/off;
an oscillation circuit having a transformer and an oscillation loop, an output current from the power indication circuit flowing to the oscillation circuit, the transformer configured to generate a high voltage to produce a resonant frequency through the oscillation loop, the oscillation loop having a oscillation loop capacitor (C3), and a transistor, the transistor having a base, a collector and an emitter, the base and the collector of the transistor being electrically collected to the transformer;

an amplifying circuit connected with at least a discharge electrode, the amplifying circuit configured to rectify current flowing to the oscillation circuit and discharge negative ions through the discharge electrode; and a high frequency eliminating circuit having a eliminating capacitor (C4), and a coil (L2), the eliminating capacitor (C4) being connected in series with the coil (L2), and the coil (L2) being connected to the emitter of the transistor in series, wherein the eliminating capacitor (C4), and the oscillation loop capacitor (C3) of the oscillation loop are both electrically connected to the base of the transistor;

a housing; and a shelter inside the housing for wrapping the transformer, the transistor and the coil (L2) of the high frequency eliminating circuit.

6. The negative ion generator in accordance with claim 5, further comprising a high frequency filtering circuit connecting the power indication circuit with the transformer of the oscillation circuit, the high frequency filtering circuit having a first capacitance (C1), a second capacitance (C2) and a coil (L1).

7. The negative ion generator in accordance with claim 5, wherein the oscillation circuit has a capacitance (C3) connected to the base of the transistor and the transformer.

8. The negative ion generator in accordance with claim 5, wherein the shelter is made of metal.

* * * * *